US008951408B2

(12) United States Patent
Tanaka et al.

(10) Patent No.: US 8,951,408 B2
(45) Date of Patent: Feb. 10, 2015

(54) METHOD FOR STARTING-UP NAPHTHA FRACTION HYDROTREATING REACTOR

(75) Inventors: Yuichi Tanaka, Yokohama (JP); Hidekatsu Honda, Tokyo (JP)

(73) Assignees: JX Nippon Oil & Energy Corporation, Tokyo (JP); Japan Oil, Gas and Metals National Corporation, Kanagawa (JP); Inpex Corporation, Tokyo (JP); Japan Petroleum Exploration Co., Ltd., Tokyo (JP); Cosmo Oil Co., Ltd., Tokyo (JP); Nippon Steel Engineering Co., Ltd., Tokyo (JP)

( * ) Notice: Subject to any disclaimer, the term of this patent is extended or adjusted under 35 U.S.C. 154(b) by 188 days.

(21) Appl. No.: 12/998,198

(22) PCT Filed: Sep. 25, 2009

(86) PCT No.: PCT/JP2009/004882

§ 371 (c)(1),
(2), (4) Date: May 4, 2011

(87) PCT Pub. No.: WO2010/038394

PCT Pub. Date: Apr. 8, 2010

(65) Prior Publication Data

US 2011/0207978 A1 Aug. 25, 2011

(30) Foreign Application Priority Data

Sep. 30, 2008 (JP) ..... 2008-254220

(51) Int. Cl.
*C07C 5/02* (2006.01)
*C07C 5/09* (2006.01)
(Continued)

(52) U.S. Cl.
CPC ..... *C10G 45/02* (2013.01); *C10G 45/00* (2013.01); *C10G 59/02* (2013.01);
(Continued)

(58) Field of Classification Search
CPC ..... C07C 5/02; C07C 5/09; C07C 5/10; C07C 5/11
USPC ..... 585/251
See application file for complete search history.

(56) References Cited

U.S. PATENT DOCUMENTS 3,253,047 A * 5/1966 Bellinger ..... 585/270
3,257,292 A * 6/1966 Cabbage ..... 203/3
(Continued)

FOREIGN PATENT DOCUMENTS

EP 1118651 A1 7/2001
EP 1272272 B1 1/2003
(Continued)

OTHER PUBLICATIONS

Mears et al., Syntheses and properties of two olefins, six paraffins, and their intermediates, Mar. 1950, Journal of Research of the National Bureau of Standards, vol. 44, pp. 299-311.*
(Continued)

*Primary Examiner* — In Suk Bullock
*Assistant Examiner* — Youngsul Jeong
(74) *Attorney, Agent, or Firm* — Kenyon & Kenyon LLP

(57) ABSTRACT

A method for starting-up a naphtha fraction hydrotreating reactor which subjects a naphtha fraction obtained in a fractionator by fractional distillation of hydrocarbon compounds produced by a Fischer-Tropsch synthesis reaction to hydrotreating, the method comprising: charging in advance an inactive hydrocarbon compound corresponding to the naphtha fraction into a vapor-liquid separator to which hydrogenated naphtha, which has been subjected to hydrotreating in the naphtha fraction hydrotreating reactor, is transferred; mixing the inactive hydrocarbon compound drawn from the vapor-liquid separator and the naphtha fractions being transferred from the fractionator to the naphtha fraction hydrotreating reactor, and supplying a mixture of the naphtha fractions and the inactive hydrocarbon compound to the naphtha fraction hydrotreating reactor.

10 Claims, 4 Drawing Sheets

(51) Int. Cl.

| | |
|---|---|
| ***C07C 5/10*** | (2006.01) |
| ***C07C 5/11*** | (2006.01) |
| ***C10G 45/02*** | (2006.01) |
| ***C10G 45/00*** | (2006.01) |
| ***C10G 59/02*** | (2006.01) |

(52) U.S. Cl.

CPC ..... *C10G 2300/1022* (2013.01); *C10G 2300/1044* (2013.01); *C10G 2300/4031* (2013.01); *C10G 2300/44* (2013.01); *C10G 2400/02* (2013.01)

USPC ..... 208/142; 208/143; 208/144; 208/145; 585/250; 585/251

(56) References Cited

U.S. PATENT DOCUMENTS

| | | | | |
|---|---|---|---|---|
| 6,037,510 | A * | 3/2000 | Vicari et al. | 585/263 |
| 2003/0141221 | A1 | 7/2003 | O'Rear et al. | |

FOREIGN PATENT DOCUMENTS

| | | |
|---|---|---|
| GB | 2 386 904 | 10/2003 |
| JP | 2004-323626 | 11/2004 |
| JP | 2005-516082 | 6/2005 |
| JP | 2007-270063 | 10/2007 |
| WO | WO 2009/041508 | 4/2009 |

OTHER PUBLICATIONS

International Search Report dated Oct. 20, 2009 issued in corresponding PCT Application No. PCT/JP2009/004882.

Klerk, "Hydroprocessing peculiarities of Fischer-Tropsch syncrude" CATAL.Today, vol. 130, No. 2-4, Jan. 2008, pp. 439-445 [as cited in the International Search Report, copy not provided].

Gregor et al., "Upgrading Fischer-Tropsch Naphtha", US DOE REP., DOE-PC-90014-T7, 1989 [as cited in the International Search Report, copy not provided].

European Search Report, dated Dec. 5, 2012, issued in corresponding European application No. 09817437.8.

Klerk, "Hydroprocessing peculiarities of Fischer-Tropsch syncrude" CATAL.Today, vol. 130, No. 2-4, Jan. 2008, pp. 439-445.

Gregor et al., "Upgrading Fischer-Tropsch Naphtha", US DOE REP., DOE-PC-90014-T7, 1989.

* cited by examiner

METHOD FOR STARTING-UP NAPHTHA FRACTION HYDROTREATING REACTOR

TECHNICAL FIELD

The present invention relates to a method for starting-up a naphtha fraction hydrotreating reactor which subjects a naphtha fraction obtained in a fractionator by fractional distillation of hydrocarbon compounds produced by a Fischer-Tropsch synthesis reaction to hydrotreating.

This application is a national stage application of International Application No. PCT/JP2009/004882, filed Sep. 25, 2009, which claims priority Japanese Patent Application No. 2008-254220, filed on Sep. 30, 2008, and the content of which is incorporated herein by reference.

BACKGROUND ART

As one method for synthesizing liquid fuels from a natural gas, a GTL (Gas To Liquids: liquid fuel synthesis) technique of reforming natural gas to produce a synthesis gas containing a carbon monoxide gas (CO) and a hydrogen gas ($H_2$) as the main components, synthesizing hydrocarbons with this synthesis gas as a source gas by the Fischer-Tropsch synthesis reaction (hereinafter, in some cases, referred to as an "FT synthesis reaction"), and further hydrogenating and fractionating the hydrocarbons to produce liquid fuel products, such as naphtha (raw gasoline), kerosene, gas oil, and wax, has recently been developed.

The liquid fuel products produced by using hydrocarbon compounds obtained by a FT synthesis reaction as a feedstock contain a large amount of paraffins and hardly any sulfur content. Therefore, as shown in Patent Document 1, such liquid fuel products have been paid attention to as environmentally-friendly fuels.

When the hydrocarbon compounds obtained by the FT synthesis reaction is fractionally distilled in a fractionator, a naphtha fraction having small numbers of carbon atoms is drawn from the upper part of the fractionator. Since such a naphtha fraction contains a large amount of olefins as well as alcohols, as shown in Patent Document 2, it is necessary to subject the naphtha fraction to a hydrotreating to produce saturated compounds.

CITATION LIST

Patent Document

[Patent Document 1] Japanese Unexamined Patent Application Publication No. 2004-323626

[Patent Document 2] Japanese Unexamined Patent Application Publication No. 2007-270063

SUMMARY OF THE INVENTION

Problem that the Invention is to Solve

Meanwhile, in a naphtha fraction hydrotreating reactor which subjects the above-mentioned naphtha fraction to hydrotreating, hydrogenation of the olefins, because of an exothermic reaction, causes a problem of temperature increase. Therefore, in normal operations, by recycling a part of inactive naphtha which has been subjected to hydrotreating (hereinafter, referred to as 'hydrogenated naphtha'), a naphtha fraction obtained in a fractionator by fractional distillation of hydrocarbon compounds produced by an FT synthesis reaction is mixed with the hydrogenated naphtha and the mixture thereof is supplied to the naphtha fraction hydrotreating reactor to control a heat generation amount per unit supplying amount.

However, when the naphtha fraction hydrotreating reactor is started up, no hydrogenated naphtha exists. Therefore, only the naphtha fraction is supplied to the naphtha fraction hydrotreating reactor.

Thus, heretofore, the naphtha fraction has been supplied in small amount in order to control heat generation. Therefore it takes a lot of time to stabilize the naphtha fraction hydrotreating reactor, thereby considerably deteriorating production efficiency.

When the heat generation in the naphtha fractions is great, it is possible to apply a method for supplying the naphtha fraction with lowered temperature at an inlet of the reactor. However, in this case, since a condition for condensing water produced by the reaction in the reactor is satisfied, the catalysts may deteriorate. On the other hand, when the temperature of the inlet of the reactor is increased to a certain level, the temperature of an outlet of the reactor is excessively increased due to the heat generation. Therefore, the catalyst may also deteriorate and the temperature of the reactor may exceed the temperature limit of materials thereof.

In consideration of the above-mentioned problems, an advantage of the present invention is to provide a method for starting-up a naphtha fraction hydrotreating reactor, which subjects a naphtha fraction of hydrocarbon compounds obtained by a FT synthesis reaction to hydrotreating, which makes it possible to control a heat generation amount during the initial operation of the reactor and proceed to a stable operation at an early stage.

Means for Solving the Problem

In order to solve the above-mentioned problems and achieve such an object, the present invention proposes the following means.

According to the invention, a method for starting-up a naphtha fraction hydrotreating reactor, which subjects a naphtha fraction obtained in a fractionator by fractional distillation of hydrocarbon compounds produced by a Fischer-Tropsch synthesis reaction to hydrotreating, the method includes: charging in advance an inactive hydrocarbon compound corresponding to the naphtha fraction into a vapor-liquid separator to which hydrogenated naphtha, which has been subjected to hydrotreating in the naphtha fraction hydrotreating reactor, is transferred; mixing the inactive hydrocarbon compound drawn from the vapor-liquid separator and the naphtha fraction being transferred from the fractionator to the naphtha fraction hydrotreating reactor; and supplying a mixture of the naphtha fraction and the inactive hydrocarbon compound to the naphtha fraction hydrotreating reactor.

In addition, according to the invention, a method for starting-up a naphtha fraction hydrotreating reactor, which subjects a naphtha fraction obtained in a fractionator by fractional distillation of hydrocarbon compounds produced by a Fischer-Tropsch synthesis reaction to hydrotreating, the method includes: charging in advance an inactive hydrocarbon compound corresponding to the naphtha fraction into a naphtha stabilizer to which hydrogenated naphtha, which has been subjected to hydrotreating by the naphtha fraction hydrotreating reactor, is transferred via a vapor-liquid separator; mixing the inactive hydrocarbon compound drawn from the naphtha stabilizer and the naphtha fraction being transferred from the fractionator to the naphtha fraction hydrotreating reactor, and supplying a mixture of the naphtha fraction and the inactive hydrocarbon compound to the naphtha fraction hydrotreating reactor.

According to the method for starting-up a naphtha fraction hydrotreating reactor having the above-mentioned configuration, when the inactive hydrocarbon compound charged in advance into the vapor-liquid separator or the naphtha stabilizer is drawn from the vapor-liquid separator or the naphtha stabilizer and mixed with the naphtha fraction, the content ratio of active materials such as olefins or the like in the mixture of the naphtha fraction and the inactive hydrocarbon compound, which is supplied to the naphtha fraction hydrotreating reactor may be reduced. Therefore, it is possible to control the heat generation due to hydrogenation. Accordingly, since it is unnecessary to excessively reduce the amount of the naphtha fraction to be supplied during starting-up of the naphtha fraction hydrotreating reactor, it is possible to proceed to a stable operation at an early stage. The inactive hydrocarbon compound is a material corresponding to the naphtha fraction, that is, a hydrocarbon compound having 5 to 10 carbon atoms, and there will be no problems even when it is mixed into the naphtha product. Therefore, it is unnecessary to provide a separating device for separating the inactive hydrocarbon compound.

Herein, as the inactive hydrocarbon compound, a hydrocarbon compound having 5 to 10 carbon atoms may be used and hydrogenated naphtha itself may be used. However, it is not preferable to use a compound which contains sulfur (S) or oxygen (O) compounds or a compound which contains a large amount of olefins or the like because they may cause heat generation when they are subjected to hydrotreating. For that reason, as a hydrocarbon compound having 5 to 10 carbon atoms, n-pentane, n-hexane, n-heptane, n-octane, n-nonane, or the like may be used. Among these, n-hexane may be used in consideration of availability or the like.

Advantage of the Invention

According to the present invention, it is possible to provide a method for starting-up a naphtha fraction hydrotreating reactor, which subjects a naphtha fraction of hydrocarbon compounds obtained by a Fischer-Tropsch synthesis reaction to hydrotreating, which makes it possible to control the heat generation amount during the initial operation of the reactor and proceed to a stable operation at an early stage.

DESCRIPTION OF EMBODIMENTS

Hereinafter, preferred embodiments of the present invention will be described with reference to the accompanying drawings.

First, with reference to FIG. 1, the overall configuration and process of a liquid fuel synthesizing system (hydrocarbon synthesis reaction system) in which a method for starting-up a naphtha fraction hydrotreating reactor according to an embodiment of the present invention is applied will be described.

Figure 1:
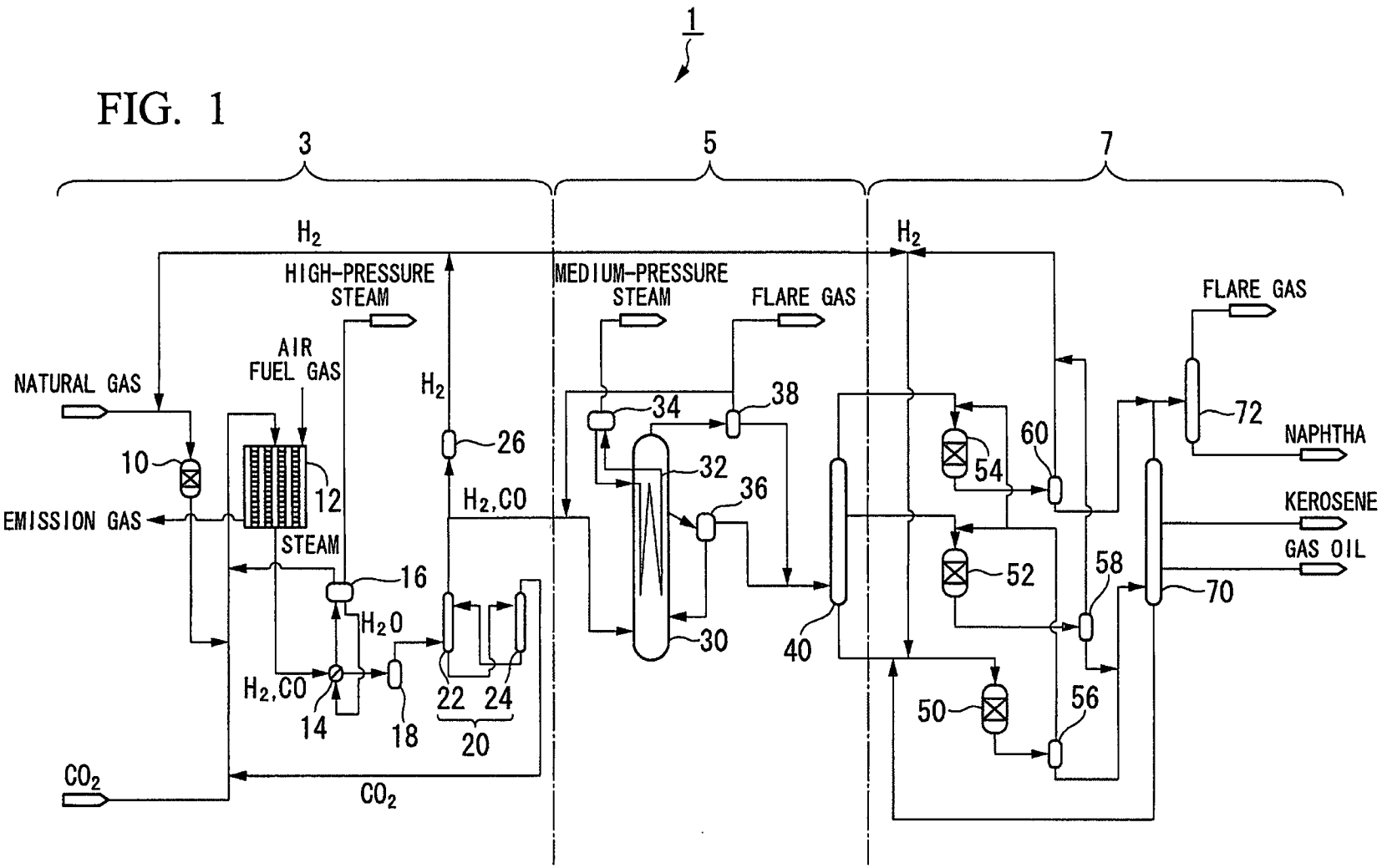
FIG. 1 is a schematic view illustrating the overall configuration of a liquid fuel synthesizing system equipped with a naphtha fraction hydrotreating reactor according to an embodiment of the present invention.

As shown in FIG. 1, a liquid fuel synthesizing system (hydrocarbon synthesis reaction system) 1 according to the embodiment is a plant facility for carrying out a GTL process which converts a hydrocarbon feedstock such as a natural gas or the like to liquid fuels. The liquid fuel synthesizing system 1 is configured with a synthesis gas production unit 3, a FT synthesis unit 5, and a product upgrading unit 7.

In the synthesis gas production unit 3, a natural gas which is a hydrocarbon feedstock is reformed to produce a synthesis gas containing a carbon monoxide gas and a hydrogen gas.

In the FT synthesis unit 5, the produced synthesis gas is subjected to Fischer-Tropsch synthesis reaction to produce liquid hydrocarbons.

In the product upgrading unit 7, the liquid hydrocarbons produced by the FT synthesis reaction are subjected to hydroprocessing and a fractional distillation to produce liquid fuel products (naphtha, kerosene, gas oil, wax, or the like). Components which configure each unit will be described below.

The synthesis gas production unit 3 mainly includes, for example, a desulfurizing reactor 10, a reformer 12, a waste heat boiler 14, vapor-liquid separators 16 and 18, a $CO_2$ removal unit 20, and a hydrogen separator 26. The desulfurizing reactor 10 is composed of a hydrodesulfurizer, etc., and removes sulfur components from a natural gas as a feedstock. The reformer 12 reforms the natural gas supplied from the desulfurizing reactor 10, to produce a synthesis gas including a carbon monoxide gas (CO) and a hydrogen gas ($H_2$) as the main components. The waste heat boiler 14 recovers waste heat of the synthesis gas produced in the reformer 12, to produce a high-pressure steam. The vapor-liquid separator 16 separates the water heated by heat exchange with the synthesis gas in the waste heat boiler 14 into a vapor (high-pressure steam) and a liquid. The vapor-liquid separator 18 removes a condensate from the synthesis gas cooled down in the waste heat boiler 14, and supplies a gas component to the $CO_2$ removal unit 20. The $CO_2$ removal unit 20 has an absorption tower 22 which removes a carbon dioxide gas by using an absorbent from the synthesis gas supplied from the vapor-liquid separator 18, and a regeneration tower 24 which desorbs the carbon dioxide gas and regenerates the absorbent including the carbon dioxide gas. The hydrogen separator 26 separates a portion of the hydrogen gas included in the synthesis gas, the carbon dioxide gas of which has been separated by the $CO_2$ removal unit 20. It is to be noted herein that the above $CO_2$ removal unit 20 is not necessarily provided depending on circumstances.

The FT synthesis unit 5 is composed of, for example, a bubble column reactor (bubble column hydrocarbon synthesis reactor) 30, a vapor-liquid separator 34, a separator 36, a vapor-liquid separator 38, and a first fractionator 40.

The bubble column reactor 30 is an example of a reactor which synthesizes liquid hydrocarbons from a synthesis gas and performs as an FT synthesis reactor which synthesizes liquid hydrocarbons from a synthesis gas by an FT synthesis reaction.

The bubble column reactor 30 is configured as, for example, a bubble column slurry bed reactor in which a slurry made by suspending solid catalyst particles in the liquid hydrocarbons (product of the FT synthesis reaction) is contained. The bubble column reactor 30 makes the synthesis gas (carbon monoxide gas and hydrogen gas) produced in the synthesis gas production unit undergo a reaction to synthesize liquid hydrocarbons.

The vapor-liquid separator 34 separates a vapor (medium-pressure steam) and a liquid from water circulated and heated in a heat transfer tube 32 arranged inside the bubble column reactor 30.

The separator 36 separates catalyst particles and liquid hydrocarbons from the slurry contained in the bubble column reactor 30.

The vapor-liquid separator 38 is connected to the top of the bubble column reactor 30 and cools down an unreacted synthesis gas and vapor hydrocarbon products.

The first fractionator 40 distills the liquid hydrocarbons supplied from the bubble column reactor 30 via the separator 36 and the vapor-liquid separator 38 and fractionates the liquid hydrocarbons to each fraction according to boiling points.

The product upgrading unit 7 is composed of, for example, a wax fraction hydrocracking reactor 50, a middle distillate hydrotreating reactor 52, a naphtha fraction hydrotreating reactor 54, vapor-liquid separators 56, 58, and 60, a second fractionator 70, and a naphtha stabilizer 72.

The wax fraction hydrocracking reactor 50 is connected to the bottom of the first fractionator 40 and the vapor-liquid separator 56 is disposed in the downstream of the reactor.

The middle distillate hydrotreating reactor 52 is connected to the middle part of the first fractionator 40 and the vapor-liquid separator 58 is disposed in the downstream of the reactor.

The naphtha fraction hydrotreating reactor 54 is connected to the upper part of the first fractionator 40 and the vapor-liquid separator 60 is disposed in the downstream of the reactor.

The second fractionator 70 fractionally distills the liquid hydrocarbons supplied from the vapor-liquid separators 56 and 58 according to boiling points.

The naphtha stabilizer 72 fractionates the liquid hydrocarbons of naphtha fractions supplied from the vapor-liquid separator 60 and the second fractionator 70, discharges butane and components lighter than butane as a flare gas (emission gas), and separates and recovers components having 5 carbon atoms or more as naphtha products.

Next, a process (GTL process) of synthesizing liquid fuels from a natural gas by the liquid fuel synthesizing system 1 configured as above will be described.

A natural gas (whose main component is $CH_4$) as a hydrocarbon feedstock is supplied to the liquid fuel synthesizing system 1 from an external natural gas supply source (not shown), such as a natural gas field or a natural gas plant. The above synthesis gas production unit 3 reforms this natural gas to produce a synthesis gas (mixed gas including a carbon monoxide gas and a hydrogen gas as the main components).

First, the above natural gas is supplied to the desulfurizing reactor 10 along with the hydrogen gas separated by the hydrogen separator 26. The desulfurizing reactor 10 hydrogenates and desulfurizes sulfur components included in the natural gas using the hydrogen gas, with, for example, a ZnO catalyst. By desulfurizing the natural gas in advance in this way, it is possible to prevent a deactivation of catalysts used in the reformer 12, the bubble column reactor 30, etc. by sulfur components.

The natural gas desulfurized in this way is supplied to the reformer 12 after the carbon dioxide ($CO_2$) gas supplied from a carbon-dioxide supply source (not shown) and the steam generated in the waste heat boiler 14 are mixed therewith. The reformer 12 reforms the natural gas by using a carbon dioxide and a steam to produce a high-temperature synthesis gas including a carbon monoxide gas and a hydrogen gas as the main components, by a steam and carbon-dioxide-gas reforming method.

The high-temperature synthesis gas (for example, 900° C., 2.0 MPaG) produced in the reformer 12 in this way is supplied to the waste heat boiler 14, and is cooled down by the heat exchange with the water which flows through the waste heat boiler 14 (for example, 400° C.), thus the waste heat is recovered. At this time, the water heated by the synthesis gas in the waste heat boiler 14 is supplied to the vapor-liquid separator 16. From this vapor-liquid separator 16, a gas component is supplied to the reformer 12 or other external devices as a high-pressure steam (for example, 3.4 to 10.0 MPaG), and water as a liquid component is returned to the waste heat boiler 14.

Meanwhile, the synthesis gas cooled down in the waste heat boiler 14 is supplied to the absorption tower 22 of the $CO_2$ removal unit 20, or the bubble column reactor 30, after a condensate is separated and removed from the synthesis gas in the vapor-liquid separator 18. The absorption tower 22 absorbs a carbon dioxide gas included in the synthesis gas into the retained absorbent, to separate the carbon dioxide gas from the synthesis gas. The absorbent including the carbon dioxide gas within this absorption tower 22 is introduced into the regeneration tower 24, the absorbent including the carbon dioxide gas is heated and subjected to stripping treatment with, for example, a steam, and the resulting desorbed carbon dioxide gas is returned to the reformer 12 from the regeneration tower 24, and is reused for the above reforming reaction.

The synthesis gas produced in the synthesis gas production unit 3 in this way is supplied to the bubble column reactor 30 of the above FT synthesis unit 5. At this time, the composition ratio of the synthesis gas supplied to the bubble column reactor 30 is adjusted to a composition ratio (for example, $H_2$:CO=2:1 (molar ratio)) suitable for the FT synthesis reaction.

A portion of the synthesis gas, the carbon dioxide gas of which has been separated by the above $CO_2$ removal unit 20, is also supplied to the hydrogen separator 26. The hydrogen separator 26 separates the hydrogen gas included in the synthesis gas, by the adsorption and desorption (hydrogen PSA) utilizing a pressure difference. This separated hydrogen is continuously supplied from a gas holder (not shown), etc. via a compressor (not shown) to various hydrogen-utilizing reaction devices (for example, the desulfurizing reactor 10, the wax fraction hydrocracking reactor 50, the middle distillate hydrotreating reactor 52, the naphtha fraction hydrotreating reactor 54, etc.) which perform predetermined reactions utilizing a hydrogen within the liquid fuel synthesizing system 1.

Next, the above FT synthesis unit 5 synthesizes liquid hydrocarbons by the FT synthesis reaction from the synthesis gas produced by the above synthesis gas production unit 3.

The synthesis gas produced in the synthesis gas production unit 3 flows in from the bottom of the bubble column reactor 30, and flows up in the catalyst slurry contained in the bubble column reactor 30. At this time, within the bubble column reactor 30, the carbon monoxide gas and the hydrogen gas which are included in the synthesis gas react with each other by the FT synthesis reaction, thereby producing hydrocarbons. Moreover, by flowing water through the heat transfer pipe 32 of the bubble column reactor 30 at the time of this synthesis reaction, the reaction heat of the FT synthesis reaction is removed, and the water heated by this heat exchange is vaporized into a steam. As for this steam, the water liquefied in the vapor-liquid separator 34 is returned to the heat transfer pipe 32, and a gas component is supplied to an external device as medium-pressure steam (for example, 1.0 to 2.5 MPaG).

The liquid hydrocarbons synthesized in the bubble column reactor 30 as described above are introduced to the separator 36 as a slurry with catalyst particles. The separator 36 separates a solid component such as the catalyst particles or the like and a liquid component containing the liquid hydrocarbons from the slurry. A part of the separated solid component such as the catalyst particles is returned to the bubble column reactor 30, and the liquid component is supplied to the first fractionator 40. From the top of the bubble column reactor 30, an unreacted synthesis gas, and a gas component of the synthesized hydrocarbons are introduced into the vapor-liquid separator 38. The vapor-liquid separator 38 cools down these gases to separate some condensed liquid hydrocarbons to introduce them into the first fractionator 40. Meanwhile, as for the gas component separated in the vapor-liquid separator 38, the unreacted synthesis gas (CO and $H_2$) is returned to the bottom of the bubble column reactor 30, and is reused for the FT synthesis reaction. Further, the emission gas (flare gas) other than target products, including as the main component hydrocarbon gas having a small carbon number ($C_4$ or less), is introduced into an external combustion facility (not shown), is combusted therein, and is then emitted to the atmosphere.

Next, the first fractionator 40 heats the liquid hydrocarbons (whose carbon numbers are various) supplied via the separator 36 and the vapor-liquid separator 38 from the bubble column reactor 30 as described above, to fractionally distill the liquid hydrocarbons utilizing a difference in boiling points into a naphtha fraction (whose boiling point is lower than about 150° C.), a middle distillate (whose boiling point is about 150 to 350° C.), and a wax fraction (whose boiling point is higher than about 350° C.).

The liquid hydrocarbons (mainly $C_{21}$ or more) as the wax fraction drawn from the bottom of the first fractionator 40 are brought to the wax fraction hydrocracking reactor 50, the liquid hydrocarbons (mainly $C_{11}$, to $C_{20}$) as the middle distillate drawn from the middle part of the first fractionator 40 are brought to the middle distillate hydrotreating reactor 52, and the liquid hydrocarbons (mainly $C_5$ to $C_{10}$) as the naphtha fraction drawn from the upper part of the first fractionator 40 are brought to the naphtha fraction hydrotreating reactor 54.

The wax fraction hydrocracking reactor 50 hydrocracks the liquid hydrocarbons as the wax fraction with a large carbon number (approximately $C_{21}$ or more), which have been supplied from the bottom of the first fractionator 40, by using the hydrogen gas supplied from the above hydrogen separator 26, to reduce the carbon number to $C_{20}$ or less. In this hydrocracking reaction, hydrocarbons with a small carbon number and with low molecular weight are produced by cleaving the C—C bonds of the hydrocarbons with a large carbon number, using a catalyst and heat. A product including the liquid hydrocarbons hydrocracked in this wax fraction hydrocracking reactor 50 is separated into a gas and a liquid in the vapor-liquid separator 56, the liquid hydrocarbons of which are brought to the second fractionator 70, and the gas component (including hydrogen gas) of which is brought to the middle distillate hydrotreating reactor 52 and the naphtha fraction hydrotreating reactor 54.

The middle distillate hydrotreating reactor 52 hydrotreats liquid hydrocarbons (approximately $C_{11}$ to $C_{20}$) as the middle distillate having a substantially middle carbon number, which have been supplied from the middle part of the first fractionator 40, by using the hydrogen gas supplied via the wax fraction hydrocracking reactor 50 from the hydrogen separator 26. In this hydrotreating reaction, in order to obtain mainly branched chain saturated hydrocarbons, the liquid hydrocarbons are isomerized, and a hydrogen is added to unsaturated bonds of the above liquid hydrocarbons to saturate them. As a result, a product including the hydrotreated liquid hydrocarbons is separated into a gas and a liquid in the vapor-liquid separator 58, the liquid hydrocarbons of which are brought to the second fractionator 70, and the gas component (including hydrogen gas) of which is reused for the above hydrogenation reaction.

The naphtha fraction hydrotreating reactor 54 hydrotreats liquid hydrocarbons (approximately $C_{10}$ or less) as the naphtha fraction with a low carbon number, which have been supplied from the upper part of the first fractionator 40, by using the hydrogen gas supplied via the wax fraction hydrocracking reactor 50 from the hydrogen separator 26. As a result, a product (hydrogenated naphtha) including the hydrotreated liquid hydrocarbons is separated into a gas and a liquid in the vapor-liquid separator 60, the liquid hydrocarbons of which are brought to the naphtha stabilizer 72, and the gas component (including hydrogen gas) of which is reused for the above hydrogenation reaction.

Next, the second fractionator 70 distills the liquid hydrocarbons supplied from the wax fraction hydrocracking reactor 50 and the middle distillate fraction hydrotreating reactor 52 as described above. Thereby, the second fractionator 70 fractionally distills the liquid hydrocarbons into hydrocarbons (whose boiling point is lower than about 150° C.) with a carbon number of $C_{10}$ or less, kerosene (whose boiling point is about 150 to 250° C.), gas oil (whose boiling point is about 250 to 350° C.), and uncracked wax fraction (whose boiling point is higher than about 350° C.) from the wax fraction hydrocracking reactor 50. An uncracked wax fraction is obtained from the bottom of the second fractionator, and is returned to the upstream of the wax fraction hydrocracking reactor 50. Kerosene and gas oil are drawn from the middle part of the second fractionator 70. Meanwhile, hydrocarbons with a carbon number of $C_{10}$ or less are drawn from the top of the second fractionator 70, and are supplied to the naphtha stabilizer 72.

Moreover, the naphtha stabilizer 72 distills the hydrocarbons with a carbon number of $C_{10}$ or less, which have been supplied from the above naphtha fraction hydrotreating reactor 54 and the second fractionator 70, thereby fractionating naphtha ($C_5$ to $C_{10}$) as a product. Accordingly, high-purity naphtha is drawn from the lower part of the naphtha stabilizer 72. Meanwhile, the emission gas (flare gas) other than products, which contains as the main component hydrocarbons with a predetermined carbon number or less ($C_4$ or less), is discharged from the top of the naphtha stabilizer 72. The emission gas (flare gas) is introduced to the outside combustion facilities (not shown in the drawing) and burned, thereby being discharged to the atmosphere.

The process (GTL process) of the liquid fuel synthesizing system 1 has been described above. By the GTL process concerned, natural gas is converted to fuels, such as high-purity naphtha ($C_5$ to $C_{10}$: raw gasoline), kerosene ($C_{11}$ to $C_{15}$), and light oil ($C_{16}$ to $C_{20}$: diesel oil).

Figure 2:
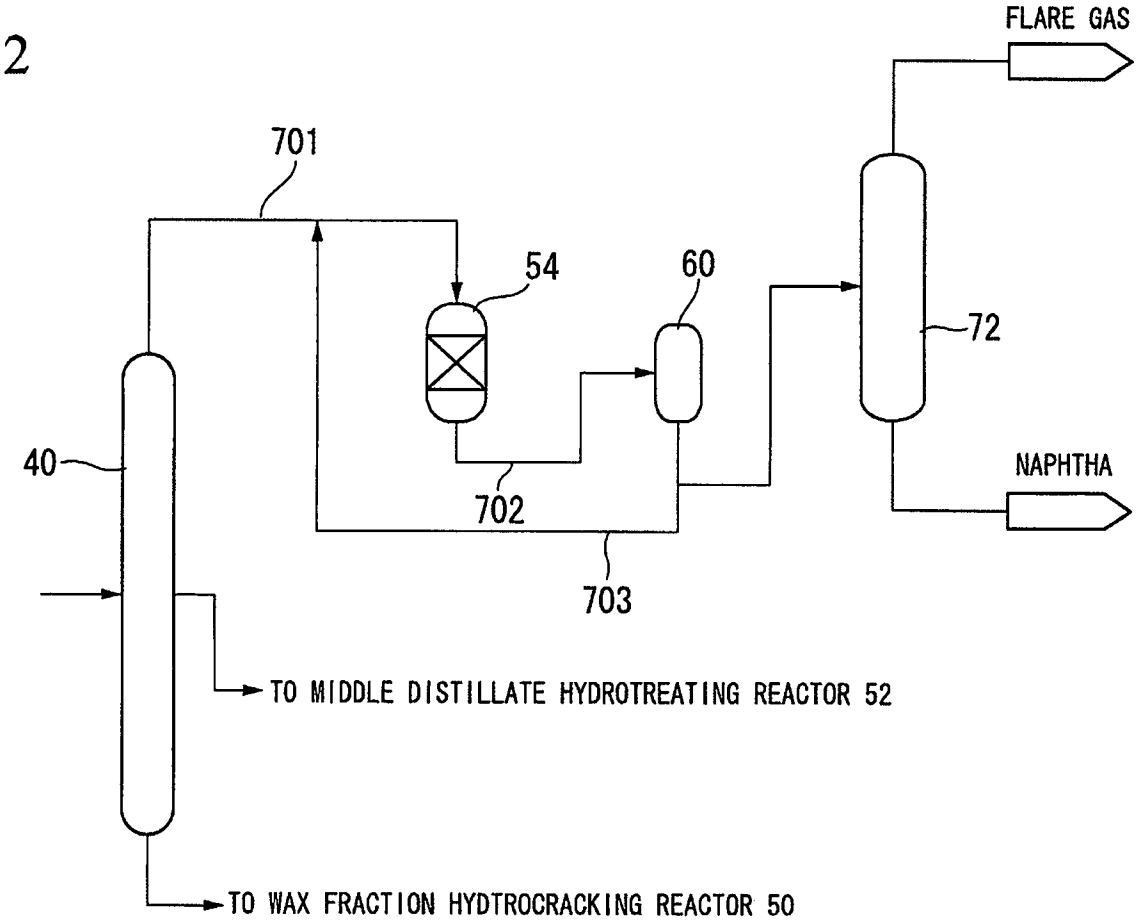
FIG. 2 is a detailed explanatory diagram illustrating the surroundings of a naphtha fraction hydrotreating reactor according to an embodiment of the present invention.

With reference to FIG. 2, the configuration and operation of the surroundings of the naphtha fraction hydrotreating reactor 54 will be described below in detail.

It is configured that the liquid hydrocarbons of the naphtha fraction are supplied to the naphtha fraction hydrotreating reactor 54 through a supply line 701 connected to the upper part of the first fractionator 40. The product (hydrogenated naphtha) containing the hydrotreated liquid hydrocarbons is brought to the vapor-liquid separator 60 via an discharge line 702.

The liquid hydrocarbons separated in the vapor-liquid separator 60 are brought to the naphtha stabilizer 72 as mentioned above. However, it is configured that a part of the separated liquid hydrocarbons is brought to the naphtha fraction hydrotreating reactor 54 from the vapor-liquid separator 60 via a recycle line 703 connected to the supply line 701.

During the normal operation of the naphtha fraction hydrotreating reactor 54, the naphtha fraction supplied from the first fractionator 40 is mixed with the hydrogenated naphtha supplied through the recycle line 703 and the mixture thereof is supplied to the naphtha fraction hydrotreating reactor 54. When the hydrogenated naphtha, which is inactive due to hydrotreating, is mixed with the naphtha fraction, heat generation during the hydrotreating in the naphtha fraction hydrotreating reactor 54 may be controlled.

However, in the case where the naphtha fraction hydrotreating reactor 54 is operated for the first time or the operation is started after being shut down for a long term due to maintenance or the like, there may be no hydrogenated naphtha stored in the vapor-liquid separator 60.

Figure 3:
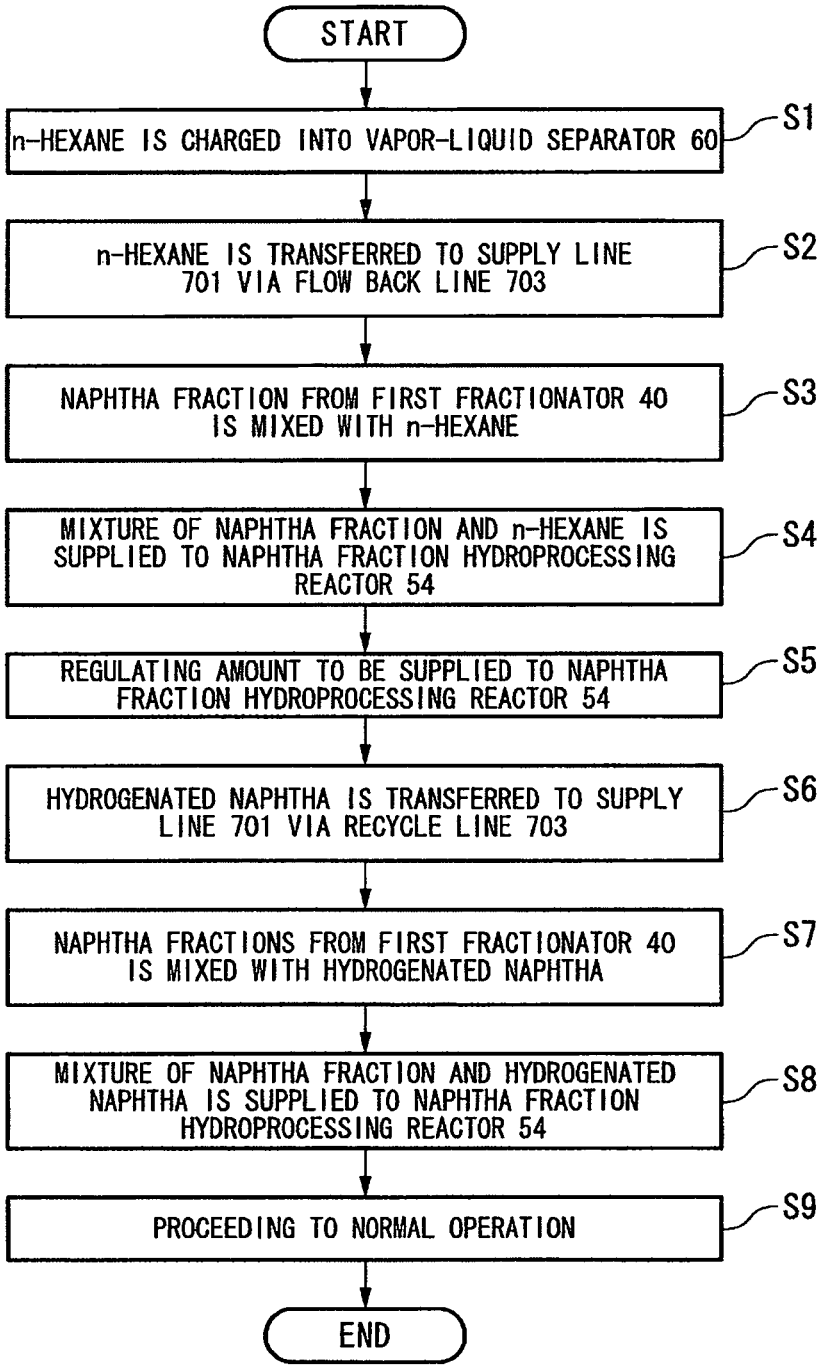
FIG. 3 is a flow diagram illustrating a method for starting-up a naphtha fraction hydrotreating reactor according to an embodiment of the present invention.

Therefore, according to this embodiment, a start-up of the naphtha fraction hydrotreating reactor 54 is carried out as shown in the flow diagram of FIG. 3.

Into the vapor-liquid separator 60, an inactive hydrocarbon compound corresponding to the naphtha fraction, that is, an inactive hydrocarbon compound having 5 to 10 carbon atoms, more preferably 5 to 8 carbon atoms, is charged (S1). According to this embodiment, n-hexane is used as the inactive hydrocarbon compound.

The n-hexane, which is the inactive hydrocarbon compound charged into the vapor-liquid separator 60, is drawn from the vapor-liquid separator 60 and transferred to the supply line 701 to the naphtha fraction hydrotreating reactor 54 via the recycle line 703 (S2). The transferred n-hexane and the naphtha fractions supplied from the first fractionator 40 are mixed (S3).

The mixture of the naphtha fraction and the n-hexane is supplied to the naphtha fraction hydrotreating reactor 54 (S4). The mixing ratio of the naphtha fraction to the n-hexane, naphtha fraction/n-hexane, is preferably in the range of 1/4 to 1/1.

The amount of the mixture to be supplied is regulated (S5), and while the heat generation in the naphtha fraction hydrotreating reactor 54 is controlled, the hydrotreating is carried out. After that, the hydrogenated naphtha is brought to the vapor-liquid separator 60.

A part of the hydrogenated naphtha stored in the vapor-liquid separator 60 is transferred to the supply line 701 via the recycle line 703 (S6). The transferred hydrogenated naphtha and the naphtha fraction supplied from the first fractionator 40 are mixed (S7). After that, the mixture of the naphtha fraction and the hydrogenated naphtha is supplied to the naphtha fraction hydrotreating reactor 54 (S8), thereby proceeding to the normal operation (S9).

In the above-mentioned manner, the start-up of the naphtha fraction hydrotreating reactor 54 is carried out. The inactive hydrocarbon compound charged into the vapor-liquid separator 60 results in flowing to the naphtha stabilizer 72 with the hydrogenated naphtha and mixing into the naphtha product.

In accordance with the method for starting-up the naphtha fraction hydrotreating reactor 54 configured as mentioned above according to this embodiment, n-hexane, which is the inactive hydrocarbon compound charged into the vapor-liquid separator 60, is transferred to the supply line 701 via the recycle line 703. After that, the n-hexane is mixed with the naphtha fraction supplied from the first fractionator 40 and the mixture thereof is supplied to the naphtha fraction hydrotreating reactor 54. Accordingly, in the naphtha fraction hydrotreating reactor 54, the concentration of active materials such as olefins or the like to which hydrogen is added is reduced. Therefore, it is possible to control the heat generation due to reaction.

When the heat generation in the naphtha fraction hydrotreating reactor 54 is controlled as mentioned above, it is unnecessary to reduce the amount of the naphtha fraction to be supplied to the naphtha fraction hydrotreating reactor 54. Therefore, it is possible to supply a large amount of the naphtha fraction from the starting stage and proceed to a stable operation at an early stage.

The inactive hydrocarbon compound such as n-hexane or the like, which is mixed with the naphtha fraction, is a material corresponding to the naphtha fraction, that is, a hydrocarbon compound having 5 to 10 carbon atoms, and there will be no problems even when it flows into the naphtha stabilizer 72 and mixes into the naphtha product. Therefore, it is unnecessary to provide a separating device for separating the inactive hydrocarbon compound such as n-hexane or the like.

The embodiments of the present invention have been described above with reference to the drawings. However, the detailed configurations are not to be considered as being limited by such embodiments and design modifications or the like can be made without departing from the spirit of the present invention.

For example, a configuration in which the inactive hydrocarbon compound is charged into the vapor-liquid separator 60 has been described. However, it should not be considered as limiting and as shown in FIG. 4, it is permissible that the inactive hydrocarbon compound is charged into the naphtha stabilizer 72 and the inactive hydrocarbon compound is transferred to the supply line 701 via the recycle line 704 disposed in the naphtha stabilizer 72.

Figure 4:
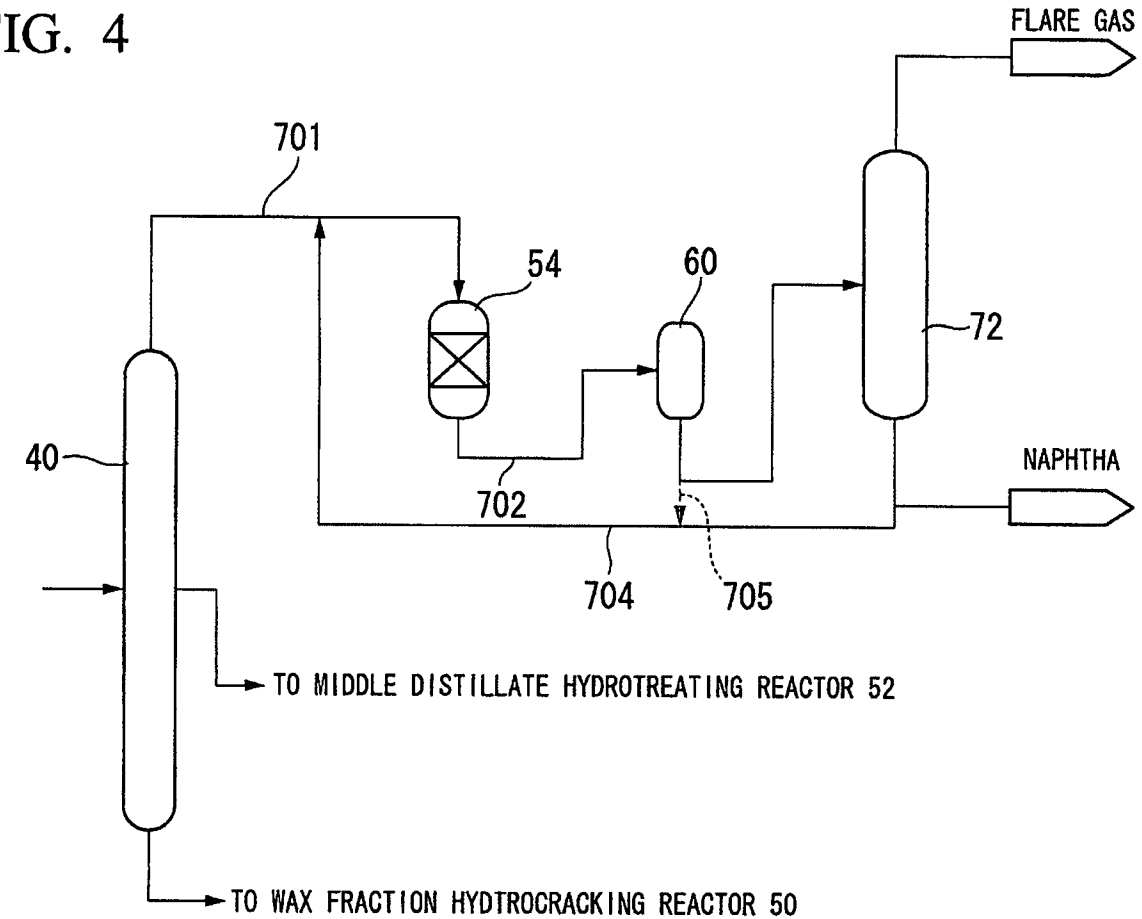
FIG. 4 is a detailed explanatory diagram illustrating the surroundings of a naphtha fraction hydrotreating reactor according to another embodiment of the present invention.

In addition, it is permissible that a connecting line 705 extended from the vapor-liquid separator 60 to the recycle line 704 is arranged as a dotted line shown in FIG. 4, and the inactive hydrocarbon compound is charged into both the vapor-liquid separator 60 and the naphtha stabilizer 72.

According to the embodiments, a configuration where the naphtha fraction supplied from the first fractionator 40 is mixed with the inactive hydrocarbon compound is described. However, it should not be considered as limiting and it is permissible that, for example, the inactive hydrocarbon compound, which is charged in advance into at least one of the vapor-liquid separator 60 and the naphtha stabilizer 72, is allowed to flow among the recycle lines 703 and 704, the supply line 701, and the hydrotreating reactor 54, and the aforementioned naphtha fraction is mixed thereto.

In addition, it is described that n-hexane is used as the inactive hydrocarbon compound. However, it should not be considered as limiting and it is permissible to use n-pentane, n-heptane, n-octane, n-nonane, or the like, and also to use the hydrogenated naphtha itself produced in advance. However, it is not preferable to use a compound, which contains sulfur (S) and oxygen (O) compounds, olefins, or the like because they may cause a heat generation when they are subjected to hydrotreating. In addition, n-hexane is the most preferable in consideration of availability or the like.

INDUSTRIAL APPLICABILITY

According to the method for starting-up a naphtha fraction hydrotreating reactor of the present invention, in the naphtha fraction hydrotreating reactor, which subjects naphtha fraction of hydrocarbon compounds obtained by a Fischer-Tropsch synthesis reaction to a hydrotreating, it is possible to control a heat generation amount during the initial operation of the reactor and proceed to a stable operation at an early stage.

DESCRIPTION OF REFERENCE NUMERALS

1: LIQUID FUEL SYNTHESIZING SYSTEM (HYDROCARBON SYNTHESIS REACTION SYSTEM)
40: FIRST FRACTIONATOR
54: NAPHTHA FRACTION HYDROTREATING REACTOR
60: VAPOR-LIQUID SEPARATOR
72: NAPHTHA STABILIZER

The invention claimed is:

1. A method for starting-up a naphtha fraction hydrotreating reactor which subjects olefins included in a naphtha fraction obtained in a fractionator by fractional distillation of hydrocarbon compounds produced by a Fischer-Tropsch synthesis reaction to hydrotreating, the method comprising:

charging in advance an inactive hydrocarbon compound into a vapor-liquid separator;

drawing the inactive hydrocarbon compound charged into the vapor-liquid separator from the vapor-liquid separator;

mixing the inactive hydrocarbon compound drawn from the vapor-liquid separator and the naphtha fraction drawn from the fractionator;

supplying a mixture of the naphtha fraction and the inactive hydrocarbon compound to the naphtha fraction hydrotreating reactor, so as to reduce the concentration of the olefins in the naphtha fraction hydrotreating reactor;

hydrotreating the naphtha fraction while the supply of the mixture is regulated so as to control heat generated in the naphtha fraction hydrotreating reactor; and transferring hydrogenated naphtha obtained by hydrotreating the naphtha fraction in the naphtha fraction hydrotreating reactor to the vapor-liquid separator wherein a mixing ratio of the naphtha fraction to the inactive hydrocarbon compound is in the range of 1/4 to 1/1 when mixing the inactive hydrocarbon compound and the naphtha fraction.

2. A method for starting-up a naphtha fraction hydrotreating reactor which subjects olefins included in a naphtha fraction obtained in a fractionator by fractional distillation of hydrocarbon compounds produced by a Fischer-Tropsch synthesis reaction to hydrotreating, the method comprising:

charging in advance an inactive hydrocarbon compound into a naphtha stabilizer;

drawing the inactive hydrocarbon compound charged into the naphtha stabilizer from the naphtha stabilizer;

mixing the inactive hydrocarbon compound drawn from the naphtha stabilizer and the naphtha fraction drawn from the fractionator;

supplying a mixture of the naphtha fraction and the inactive hydrocarbon compound to the naphtha fraction hydrotreating reactor, so as to reduce the concentration of the olefins in the naphtha fraction hydrotreating reactor;

hydrotreating the naphtha fraction while the supply of the mixture is regulated so as to control heat generated in the naphtha fraction hydrotreating reactor; and transferring hydrogenated naphtha obtained by hydrotreating the naphtha fraction in the naphtha fraction hydrotreating reactor to the naphtha stabilizer via a vapor-liquid separator wherein a mixing ratio of the naphtha fraction to the inactive hydrocarbon compound is in the range of 1/4 to 1/1 when mixing the inactive hydrocarbon compound and the naphtha fraction.

3. The method for starting-up a naphtha fraction hydrotreating reactor according to claim 1 or 2, wherein the inactive hydrocarbon compound has 5 to 10 carbon atoms.

4. The method for starting-up a naphtha fraction hydrotreating reactor according to claim 1 or 2, wherein the inactive hydrocarbon compound is hydrogenated naphtha.

5. The method for starting-up a naphtha fraction hydrotreating reactor according to claim 1 or 2, wherein the inactive hydrocarbon compound is composed of at least one of n-pentane, n-hexane, n-heptane, n-octane, and n-nonane.

6. The method for starting-up a naphtha fraction hydrotreating reactor according to claim 1 or 2, wherein the inactive hydrocarbon compound is n-hexane.

7. The method for starting-up a naphtha fraction hydrotreating reactor according to claim 1, the method further comprising:

drawing a part of the hydrogenated naphtha transferred to the vapor-liquid separator from the vapor-liquid separator;

mixing the part of the hydrogenated naphtha drawn from the vapor-liquid separator and the naphtha fraction drawn from the fractionator; and supplying a mixture of the naphtha fraction and the hydrogenated naphtha to the naphtha fraction hydrotreating reactor.

8. The method for starting-up a naphtha fraction hydrotreating reactor according to claim 2, the method further comprising:

drawing a part of the hydrogenated naphtha transferred to the naphtha stabilizer from the naphtha stabilizer;

mixing the part of the hydrogenated naphtha drawn from the naphtha stabilizer and the naphtha fraction drawn from the fractionator; and supplying a mixture of the naphtha fraction and the hydrogenated naphtha to the naphtha fraction hydrotreating reactor.

9. The method for starting-up a naphtha fraction hydrotreating reactor according to claim 1, wherein mixing the inactive hydrocarbon compound drawn from the vapor-liquid separator and the naphtha fraction drawn from the fractionator, before the inactive hydrocarbon compound reaches the naphtha fraction hydrotreating reactor.

10. The method for starting-up a naphtha fraction hydrotreating reactor according to claim 2, wherein mixing the inactive hydrocarbon compound drawn from the naphtha stabilizer and the naphtha fraction drawn from the fractionator, before the inactive hydrocarbon compound reaches the naphtha fraction hydrotreating reactor.

* * * * *

UNITED STATES PATENT AND TRADEMARK OFFICE

CERTIFICATE OF CORRECTION

PATENT NO. : 8,951,408 B2
APPLICATION NO. : 12/998198
DATED : February 10, 2015
INVENTOR(S) : Yuichi Tanaka et al.

It is certified that error appears in the above-identified patent and that said Letters Patent is hereby corrected as shown below:

In the specification

Column 7, line 37, change "(mainly $C_{11}$, to $C_{20}$)" to -- (mainly $C_{11}$ to $C_{20}$) --;

In the claims

Column 11, line 38, Claim 1, change "to the vapor-liquid separator" to -- to the vapor-liquid separator, --; and Column 12, line 2, Claim 2, change "vapor-liquid separator wherein" to -- vapor-liquid separator, wherein --.

Signed and Sealed this
Third Day of November, 2015

Michelle K. Lee

Michelle K. Lee
*Director of the United States Patent and Trademark Office*